US006893150B2

(12) United States Patent
Burch

(10) Patent No.: US 6,893,150 B2
(45) Date of Patent: May 17, 2005

(54) SYSTEM FOR PREVENTING THE ACCUMULATION OF CONCRETE FROM A FLIGHT IN A CONCRETE MIXING DRUM

(76) Inventor: Leon A. Burch, 11 Christy La., Naugatuck, CT (US) 06770

( * ) Notice: Subject to any disclaimer, the term of this patent is extended or adjusted under 35 U.S.C. 154(b) by 333 days.

(21) Appl. No.: 10/266,879

(22) Filed: Oct. 8, 2002

(65) Prior Publication Data

US 2004/0065357 A1 Apr. 8, 2004

(51) Int. Cl.[7] ..... B28C 5/20; B28C 5/42
(52) U.S. Cl. ..... 366/59; 366/138; 366/227
(58) Field of Search ..... 366/56–59, 227, 366/138; 432/118

(56) References Cited

U.S. PATENT DOCUMENTS 4,188,127 A * 2/1980 Pawley
5,244,498 A 9/1993 Steinke
5,507,875 A 4/1996 Hailey
5,718,508 A * 2/1998 Williams ..... 366/138
6,418,948 B1 7/2002 Harmon

FOREIGN PATENT DOCUMENTS

GB 2115712 * 9/1983
JP 10-34644 * 2/1998

* cited by examiner

*Primary Examiner*—Charles E. Cooley
(74) *Attorney, Agent, or Firm*—Edwards & Angell LLP

(57) ABSTRACT

A system for removing concrete from a helical flight extending along the interior surface of a concrete mixing drum that includes an expandable conduit configured to move between an unexpanded position and an expanded position to dislodge concrete accumulated thereon during rotation of the drum.

31 Claims, 4 Drawing Sheets

FIG. 1
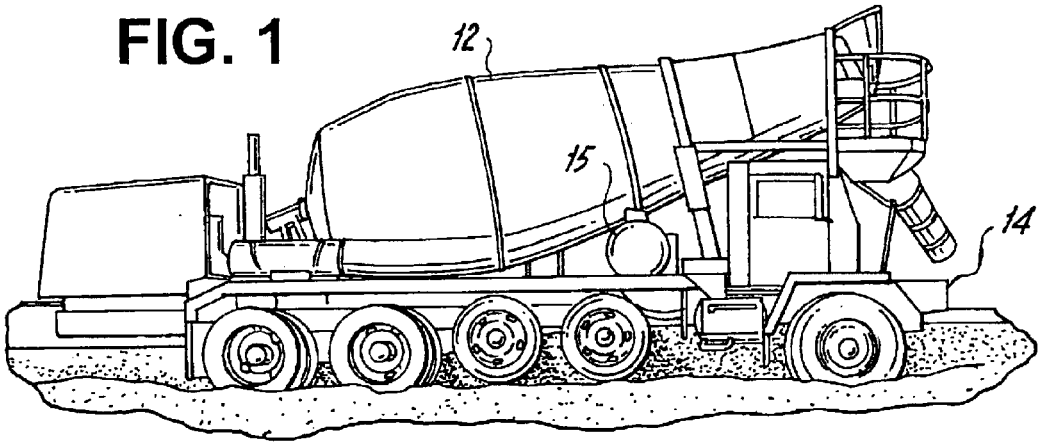
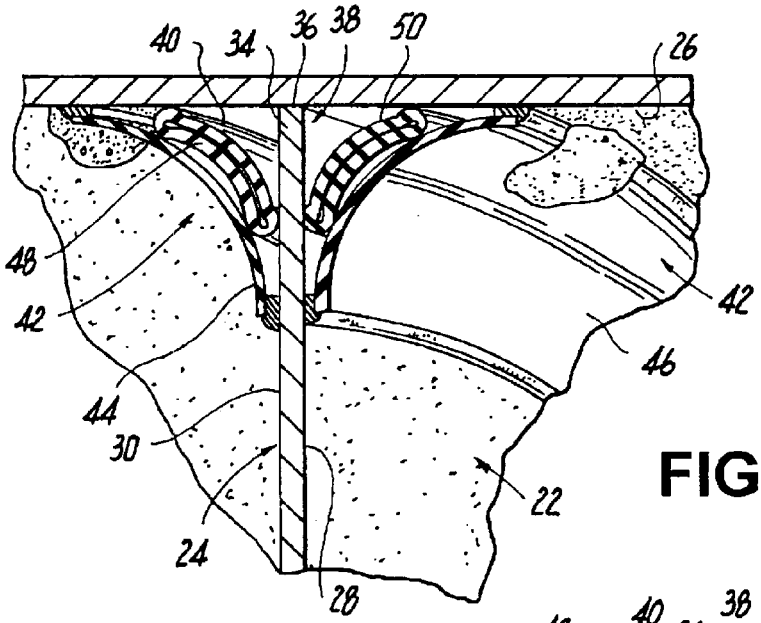
FIG. 3
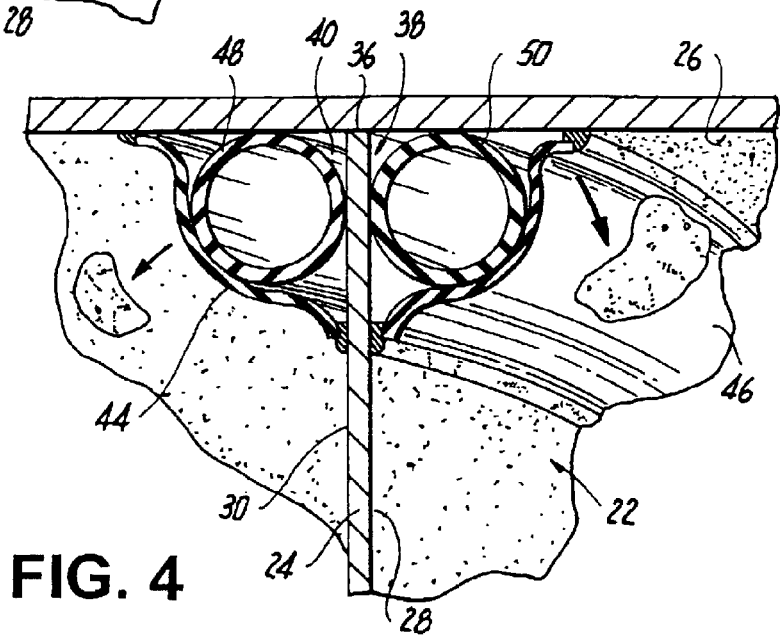
FIG. 4

SYSTEM FOR PREVENTING THE ACCUMULATION OF CONCRETE FROM A FLIGHT IN A CONCRETE MIXING DRUM

BACKGROUND OF THE INVENTION

1. Field of the Invention

The subject disclosure relates generally to a system for removing residual or accumulated concrete from interior surfaces of a concrete mixing drum, and more particularly, to a system for releasing or dislodging concrete accumulated on or about the helical flights of a concrete mixing drum.

2. Background of the Related Art

Ready-mix concrete trucks, such as the truck illustrated in FIG. 1, have a rotatable drum for holding a quantity of ready-mix concrete. The drum typically includes several raised helical ribs or flights extending around its interior surfaces. These ribs act to mix the concrete when the drum is rotated in one direction, and when the drum is rotated in the opposite direction, the ribs lift the concrete to an elevated opening, either at the front or rear of the drum, through which the concrete is discharged from the drum.

Over the course of operation, concrete has been found to accumulate on the surfaces in the drum and the flight, particularly on the surfaces of the flight facing away from the open end of the drum. This concrete, if left in place to cure and harden, will decrease the effectiveness of the flights for both mixing and lifting the concrete, and adds weight to the truck. Furthermore, if allowed to accumulate, the concrete will also lessen the capacity of the drum. Therefore, it is common practice, at the end of each day, or more often, to wash the interior of the drum. However, the washing typically requires as much as 300 gallons of water, and still has been found to be ineffective at removing the accumulated concrete from the surfaces of the ribs facing opposite the open end of the drum, especially if the concrete is allowed to cure and harden.

Various apparatus and methods for removing concrete and cleaning concrete mixing drums have been used in the past, such as, for example, a hand held probe for spraying a set retarding agent against the residual concrete on the inner surface of the drum, a vibration impact device applied against the exterior of the concrete mixing drum for loosening and dislodging the accumulated concrete. These have shortcomings such as the ineffectiveness of the retarding agents under a variety of environmental conditions such as elevated temperatures and for removing concrete that has largely or mostly cured. Limitations of using devices which extend into a drum include unwieldiness, particularly when using pressurized fluids. Also, the fluid must be disposed of thereafter and it is unsafe to rotate the drum when devices are extended therein, particularly hand held devices. Shortcomings of vibrational methods of cleaning concrete mixing drums include the noise generated by the vibrating devices and the time required.

Ultimately, it has been found that the known cleaning apparatus and methods often still leave sufficient residual concrete on the interior surfaces of the drum so as to require periodic manual cleaning. This typically involves a worker entering the drum, and using a water hose and hand or power tools as required, loosening the concrete from the drum surfaces and washing the concrete pieces to the bottom of the drum. When all the concrete is loose, the worker exits the drum, and the drum is rotated so as to discharge the cleaning water and concrete pieces from the drum.

It should be readily apparent that manual cleaning of a mixing drum is tedious, and furthermore, poses significant risk of injury to the worker. The worker may be injured while entering or exiting the drum, which requires a ladder or similar means, or from slipping or falling on the wet surfaces in the drum. Injury may also be caused by loosened pieces of concrete which can fall from the upper surfaces in the drum. In addition, it is noisy in the drum during the cleaning operation as a jackhammer, sledge hammer or similar device is typically used to beat the concrete off of the interior surfaces.

Accordingly, the present invention is directed to overcoming the shortcomings of prior art systems.

SUMMARY OF THE INVENTION

The subject invention overcomes the shortcoming of the prior art by providing, among other things, a means or device disposed within the drum along at least one of the surfaces of the helical flight for preventing the accumulation of concrete thereon.

In particular, the subject invention provides a concrete delivery truck including a chassis, mixing drum rotatably associated with the chassis and a helical flight extending along the interior surface of the mixing drum for delivering concrete to the open end of the drum. The helical flight has opposed side surfaces and opposed radially inner and radially outer ends with respect to the axis of rotation of the drum. The radially outer end of the helical flight combines with the interior surface of the cavity so as to define opposed radially outer convergence zones adjacent the opposed side surfaces of the helical flight. The subject invention further includes a means or device disposed within at least one, but preferably both, of these opposed radially outer convergence zones which prevents the accumulation of concrete therein.

In one embodiment of a truck constructed or retrofitted in accordance with the subject invention, the means disposed within at least one of the opposed radially outer convergence zones for preventing the accumulation of concrete therein includes an expandable membrane extending across the opposed outer convergence zone from the adjacent side surface of the flight to the interior surface of the drum and an expandable conduit disposed beneath the membrane in the convergence zone. The membrane may be fabricated of any suitable elastomer, and secured to an adjacent side surface of the flight and the interior surface of the drum by way of adhesives or by using fasteners. The membrane and conduit are configured to move between an unexpanded position and an expanded position to dislodge concrete accumulated thereon during rotation of the drum.

In another embodiment of a truck in accordance with the subject invention, the means disposed within at least one of the opposed radially outer convergence zones for preventing the accumulation of concrete therein includes an expandable conduit configured to move between an unexpanded position and an expanded position to dislodge concrete accumulated thereon during rotation of the drum.

The flight may further include a fin at the radially inner end of the helical flight which defines opposed radially inner convergence zones between the fin and adjacent side surfaces of the flight. A further embodiment of the present invention discloses one or more fluid dispensing conduits disposed in the opposed radially inner convergence zones. The fluid dispensing conduits preferably include openings configured to dispense fluid in the general direction of a respective radially outer convergence zone.

The subject invention is also directed to a concrete mixing drum having an interior cavity defining an interior surface and a central axis of rotation extending between a closed end and an open end. The drum includes a helical flight such as the helical flight describe previously, (i.e., having opposed side surfaces and opposed radially inner and radially outer ends, the radially outer end of the flight combining with the interior surface of the cavity so as to define opposed radially outer convergence zones adjacent the opposed surfaces of the helical flight) and means or a device disposed within at least one, but preferably both, of the opposed radially outer convergence zones for preventing the accumulation of concrete therein.

In one embodiment of a drum constructed or retrofitted in accordance with the subject invention, the means or device disposed within at least one of the opposed radially outer convergence zones for preventing the accumulation of concrete therein includes an expandable membrane extending across the opposed outer convergence zone from the adjacent side surface of the flight to the interior surface of the drum and an expandable conduit disposed beneath the membrane in the convergence zone. The membrane and conduit are configured to move between an unexpanded position and an expanded position to dislodge concrete accumulated thereon during rotation of the drum.

As in the previous embodiment, the membrane may be fabricated of any elastomer, and secured to an adjacent side surface of the flight and the interior surface of the drum by way of adhesives or by fasteners.

In another embodiment of a drum in accordance with the subject invention, the means disposed within at least one of the opposed radially outer convergence zones for preventing the accumulation of concrete therein may include an expandable conduit configured to move between an unexpanded position and an expanded position to dislodge concrete accumulated thereon during rotation of the drum.

The helical flight may further include a fin at the radially inner end of the helical flight which defines opposed radially inner convergence zones between the fin and adjacent side surfaces of the flight. A further embodiment of the present invention discloses fluid dispensing conduits disposed in each of the opposed radially inner convergence zones. Each of the fluid dispensing conduits preferably include openings configured to dispense fluid in the general direction of a respective radially outer convergence zone.

The subject invention is further directed to a system for removing concrete from a helical flight extending along the interior surface of a concrete mixing drum, such as that described above (i.e., having opposed side surfaces and opposed radially inner and radially outer ends, the radially outer end of the flight combining with the interior surface of the cavity so as to define opposed radially outer convergence zones adjacent the opposed surfaces of the helical flight) and means or a device disposed within at least one, but preferably both, of the opposed radially outer convergence zones for preventing the accumulation of concrete therein.

In a system constructed in accordance with the subject invention, the means disposed within at least one of the opposed radially outer convergence zones for preventing the accumulation of concrete can include an expandable membrane extending across the opposed outer convergence zone from the adjacent side surface of the flight to the interior surface of the drum and an expandable conduit disposed beneath the membrane in the convergence zone. The membrane and conduit are configured to move between an unexpanded position and an expanded position to dislodge concrete accumulated thereon during rotation of the drum.

In another embodiment of a system in accordance with the subject invention, the means disposed within at least one of the opposed radially outer convergence zones for preventing the accumulation of concrete therein includes an expandable conduit configured to move between an unexpanded position and an expanded position to dislodge concrete accumulated thereon during rotation of the drum.

The helical flight may further include a fin at the radially inner end of the helical flight which defines opposed radially inner convergence zones between the fin and adjacent side surfaces of the flight. A further embodiment of the present invention discloses fluid dispensing conduits disposed in one or more of the opposed radially inner convergence zones. The one or more fluid dispensing conduits preferably include openings configured to dispense fluid in the general direction of a respective radially outer convergence zone.

It is an aspect of the subject invention that the flight, fin and/or interior surface of the mixing drum may further include a wear-resistant coating.

These and other unique features of the apparatus constructed in accordance with the subject disclosure will become more readily apparent from the following description of the drawings taken in conjunction with the detailed description of the exemplary and presently preferred embodiments.

BRIEF DESCRIPTION OF THE DRAWINGS

So that those having ordinary skill in the art to which the subject invention pertains will more readily understand how to make and use the same, exemplary and presently preferred embodiments thereof will be described in detail hereinbelow with reference to the accompanying drawings, wherein:

FIG. 1 is a side elevational view of an exemplary ready-mix concrete truck having a mixing drum which includes a cleaning system constructed in accordance with an embodiment of the present disclosure;

FIG. 3 is a cross-sectional view of the helical flight, taken along line 3—3 of FIG. 2, illustrating an embodiment of the cleaning system of the present disclosure in an unexpanded condition;

FIG. 4 is a cross-sectional view of the helical flight, taken along line 3—3 of FIG. 2, illustrating the cleaning system of FIG. 3 in an expanded condition to dislodge concrete accumulated thereon;

Figure 2:
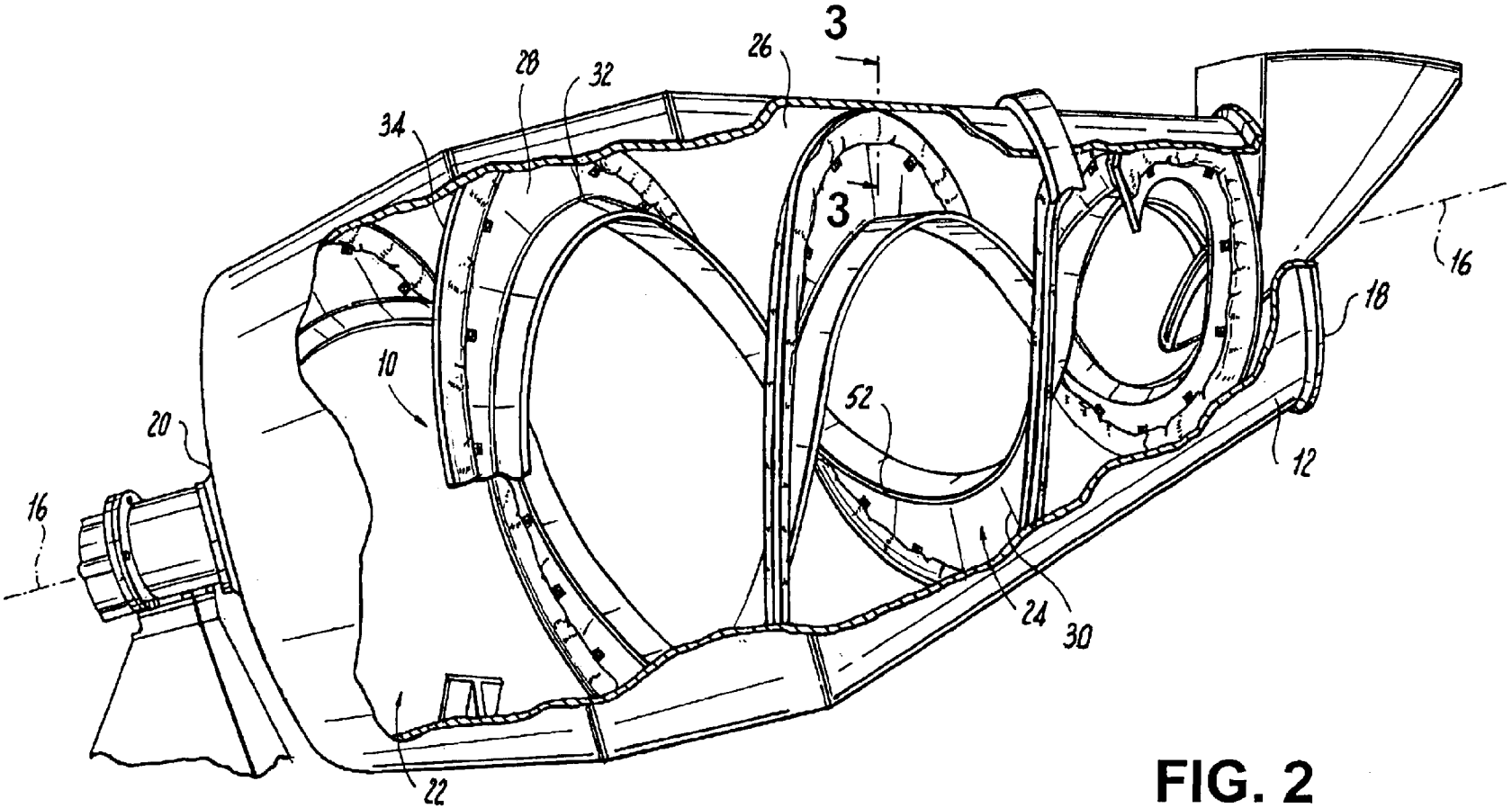
FIG. 2 illustrates the interior cavity of the mixing drum on the truck of FIG. 1, which includes a helical flight for mixing concrete and wherein an embodiment of a cleaning system constructed in accordance with the present disclosure is operatively associated with the helical flight.

These and other features of the system constructed in accordance with the present disclosure will become more readily apparent to those having ordinary skill in the art from the following detailed description of the exemplary and presently preferred embodiments.

DETAILED DESCRIPTION OF THE PREFERRED EMBODIMENTS

Concrete mixing drums are illustrated and discussed hereafter for purposes of illustrating and describing the advantageous features of an apparatus constructed in accordance with the present disclosure. However, the exemplary apparatus may fully function as advantageously in similar circumstances, such as for removing a viscous substance or substance made solid by coalescence from a vessel having interior ribs, flights, baffles, or wherein removal of a substance is otherwise problematic.

Referring to the drawings, FIG. 1 illustrates a ready mix truck 14 having a chassis 15 and a rotatable mixing drum 12 that includes the cleaning system of the subject invention which is generally designated by the reference character 10. It should be understood that truck 14 is intended to be representative of a wide variety of trucks used for mixing and delivering concrete to job sites, and generally includes means operable with drum 12 for causing drum 12 to rotate in either a clockwise or counterclockwise direction about a drum axis 16.

As shown in FIG. 2, drum 12 has an open end 18, a closed end 20, and an interior cavity 22. A generally helical rib or flight 24 extends along the interior surface 26 of interior cavity 22. The interior cavity 22 and flight 24 may be coated with an abrasion-resistant or wear-resistant co-polymer coating or any other material that imparts a resistance to concrete adherence to the coated surface. Depending on the rotation of drum 12, helical flight 24 either assists in the mixing and moving of concrete within interior cavity 22 or the discharging of concrete through open end 18. Helical flight 24 defines laterally opposed side surfaces 28 and 30, and generally defines radially inner and radially outer ends 32 and 34 relative to drum axis 16. The first side surface 28 faces the open end 18 of drum 12 and the second side surface 30 faces the closed end 20 of drum 12. Flight 24 may extend into cavity 22 at various angles with respect to axis 16. Thus, radially inner end 32 extends in the general direction of the center of cavity 22 of drum 12 and radially outer end 34 is secured to interior surface 26 of cavity 22 by any conventional means, such as welding or fasteners.

In some mixing drums, such as that which is shown herein, an elongated fin 52 is provided at the radially inner edge 32 of flight 24. Preferably, surfaces 28 and 30 are substantially planar. It should be noted that drum 12 is intended to be representative of a wide variety of commercially available drums of different sizes, shapes, and number and arrangement of flights, system 10 having utility for removing concrete from the interior surfaces of all such drums.

As best illustrated by FIGS. 3 and 4, the junction of the helical flight 24 and the interior surface 26 of drum 12 form laterally opposed convergence zones 38 and 40 on either side of the flight 24. These zones of convergence are usually susceptible to an accumulation of concrete in conventional mixing drums such as drum 12 shown herein.

In the subject invention, a concrete expulsion device 42 is positioned within zones 38 and 40 to prevent and forcibly remove or dislodge concrete that gathers or accumulates within zones 38 and 40. In this embodiment, concrete expulsion device 42 comprises elongated elastic membranes 44 and 46 disposed over expandable fluid carrying members or conduits 48 and 50. Membranes 44 and 46 and fluid carrying members 48 and 50 extend within zones 38 and 40 from the open end 18 to the closed end 20, and thus, generally follow the helical configuration of flight 24. Preferably, membranes 44 and 46 have a first end secured to the interior surface 26 and a second end secured to a respective side surface 28 or 30 of flight 24 by any conventional means, such as by way of adhesive or by fasteners (e.g., screws, bolts, rivets, clamps, brackets, etc.), or combinations thereof.

As illustrated by this embodiment, membranes 44 and 46 maintain fluid carrying members 48 and 50 within zones 38 and 40 in a manner which effectively covers zones 38 and 40, thus preventing concrete from accumulating therein. As shown in FIG. 4, in operation the membranes 44 and 46 are moved to an expanded or actuated condition by the expansion of fluid carrying members 48 and 50. This causes the expansion of membranes 44 and 46 into cavity 22 to dislodge accumulated concrete.

Members 48 and 50 are connected to or otherwise operatively associated with a pumping device (not shown) at one of each respective ends for filling with either air or water and sealed at the opposing ends (not shown). Compressed air may be supplied by the vehicle's pneumatic system or an independent air compressor. In the inactive or unexpanded condition, membranes 44 and 46 compress fluid carrying members 48 and 50 within zones 38 and 40 in the general direction of convergence 36, as shown in FIG. 3. The expansion of members 48 and 50 is of sufficient strength to substantially overcome the tensile strength of elastic membranes 44 and 46. Thus, membranes 44 and 46 are rapidly expanded to expel concrete remaining within zones 38 and 40.

Membranes 44 and 46 may be fabricated of any suitable material having elastic properties and suitable tensile strength to be expanded numerous times yet return to its original unexpanded or rest state without alteration to its shape or elasticity, such as an elastomer like neoprene. Expandable fluid carrying members 48 and 50 may be fabricated of any expandable material having sufficient strength to handle the internal pressure necessary to expand and overcome the resistance of membranes 44 and 46, thus, pushing membranes 44 and 46 outwardly. In addition, the material preferably will yield to the tensile strength of membranes 44 and 46 when in members 48 and 50 are in the unexpanded condition. Preferably, members 48 and 50 are collapsible hoses, that may be formed from a tightly woven fabric such as in a conventional a fire hose. Typically, fluid pressure within the expandable members 48 and 50 may range from about 120 psi to about 150 psi when using air supplied by the vehicle and about 50 psi to about 75 psi when using water.

Figure 5:
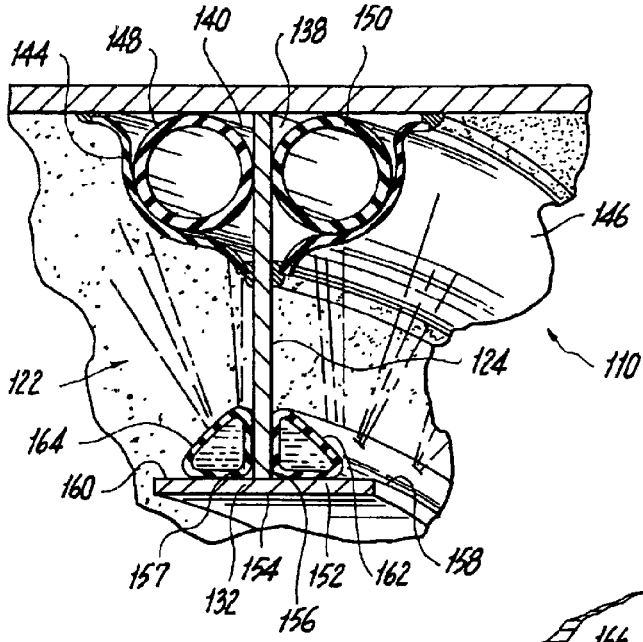
FIG. 5 is a cross-sectional view of the helical flight which includes a weeping hose for spraying fluid to assist in the removal of concrete.
Figure 6:
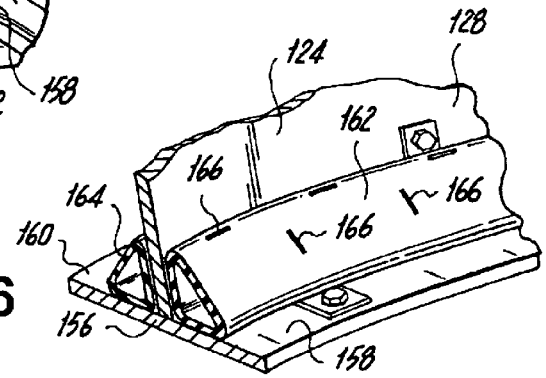
FIG. 6 is a perspective view in cross-section of the helical flight of FIG. 5 illustrating the weeping hose attached to the fin associated with the radially inner end of the flight.
Figure 7:
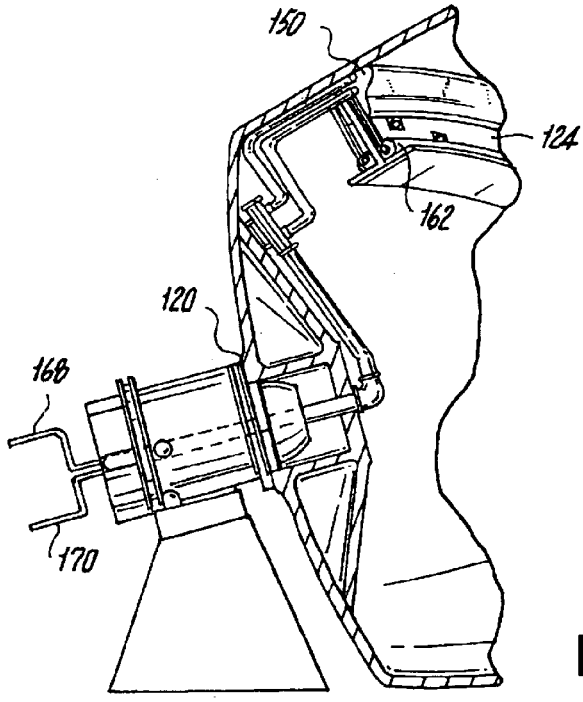
FIG. 7 is a cross-sectional view of the closed end of the mixing drum illustrating exemplary connections which facilitate operation of the cleaning system of the subject invention.

Referring to FIGS. 5 through 7, there is illustrated a helical flight 124 that further includes an elongated fin 152 disposed on the radially inward end 132 thereof. Preferably, fin 152 extends the entire length of flight 124 and is secured to edge 132 by any conventional means, such as welding, metal fasteners, or the like.

As shown in FIG. 5, fin 152 includes a radially inner surface 154 exposed to interior cavity 122. The opposing radially outer surface is divided into two surfaces, 158 and 160, separated by the junction or convergence of fin 152 with flight 124. Surface 158 radially opposes outer zone 138 and surface 160 radially opposes outer zone 140. The convergence of fin 152 with flight 124 creates two laterally opposed, radially inner zones of convergence 156 and 157.

In this embodiment, fluid conduits or weeping hoses 162 and 164 are disposed on surfaces 158 and 160, respectively, adjacent to flight 124 and radially opposed to membranes 144 and 146. Preferably, fluid conduits 162 and 164 are either triangular in shape, positioned or otherwise arranged so that concrete may not set or accumulate in the space between conduits 162 and 164 and radially inner zones 156 and 157. Fluid conduits 162 and 164 may be secured by adhesives or fasteners (e.g., screws, bolts, rivets, clamps, brackets, etc.), or any combination thereof.

As best viewed in FIG. 6, a plurality of slits or openings 166 are formed along fluid carriers 162 and 164. Preferably, openings 166 are evenly spaced apart and configured to spray fluid in wide angled stream. When there is no fluid pressure in conduits 162 or 164, the slits 166 remain tightly closed so that no concrete can accumulate therein. When conduits 162 and 164 are pressured with fluid, the slits 166 open in an outward direction to discharge the fluid. As illustrated in FIG. 5, slits 166 are positioned to direct fluid from within conduits 162 and 164 radially outward in the general direction of outer zones 138 and 140 when system 110 is in the expanded condition. Thus, fluid from conduits 162 and 164 may be sprayed onto membranes 144 and 146 in combination with the expansion thereof to further assist in concrete removal from flight 124. Preferably, the fluid carried within fluid conduits 162 and 164 comprises water or a solvent for assisting in the removal of concrete, or a combination thereof.

At one set of respective ends, conduits 162 and 164 are connected to or otherwise operatively associated with a fluid pump (not shown) and are sealed at the opposing ends (not shown) to form a closed circuit. FIG. 7 illustrates exemplary connective ends 168 and 170 which are associated with expandable members 148 and 150 and fluid carriers 162 and 164 of system 110, respectively. Connective ends extend from closed end 120 of drum 112 for connection with pumping devices or compressors (not shown), external or internal to the vehicle, which are necessary for actuating system 110.

Figure 8:
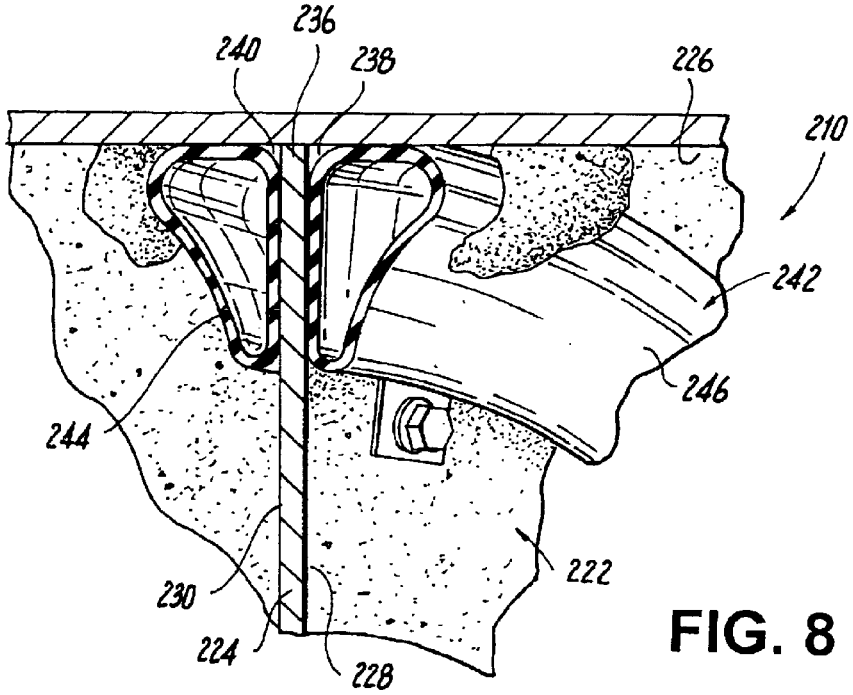
FIG. 8 is a cross-sectional view of a helical flight which includes an alternative embodiment of the cleaning system in an unexpanded condition.
Figure 9:
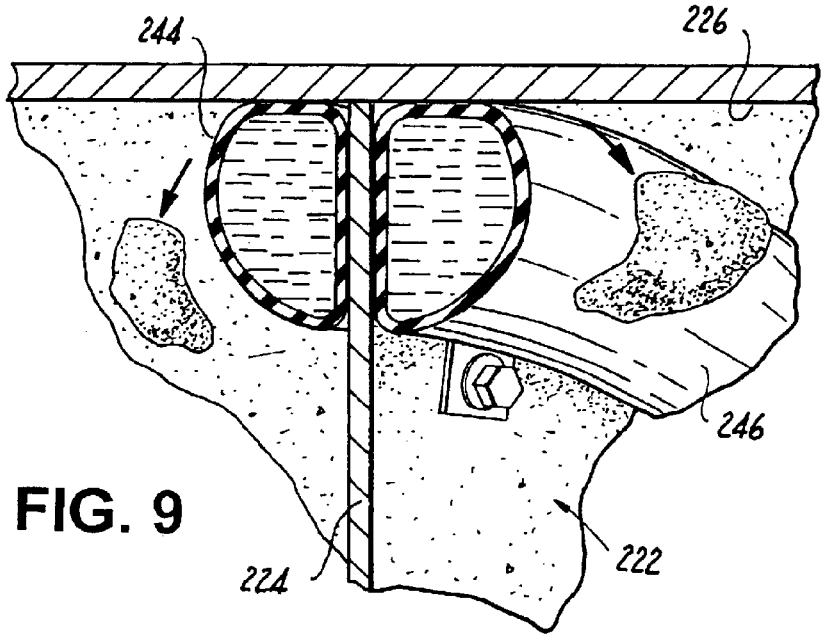
FIG. 9 is a cross-sectional view of the cleaning system shown in FIG. 8 in an expanded condition.

Referring to FIGS. 8 and 9, there is illustrated a cleaning system 210 that includes a concrete expulsion device 242 having expandable fluid carrying members or conduits 244 and 246 disposed in respective convergence zones 238 and 240. Conduits 244 and 246 have sufficient durability and flexibility to dislodge concrete accumulated thereon and expel it from the zones 238 and 240 when moved to an expanded condition. Air or water may be used to expand conduits 244 and 246. It is envisioned that cleaning system 210 may also include weeping hoses disposed in the radially inner convergence zones of helical flight 224, such as the fluid conduits shown in the previous embodiment.

In accordance with the present disclosure, the supply device or devices (e.g., air compressor and water tank and pump) may be incorporated with existing onboard equipment on the truck, retrofitted or independent of the truck. The embodiments described herein may also be retrofitted to an already existing truck. In the case of a retrofit, the system may be connected to or otherwise operatively associated with the various supply devices through the open end. The system may be controlled by manual operation of the supply devices or by onboard or remote control devices using radio frequency waves or direct electrical connections.

The subject disclosure provides a system for forcibly removing concrete from portions of a concrete mixing drum having physical features or portions which gather concrete and impede concrete flow from the mixing drum. Although the preferred and exemplary embodiments of the present disclosure have been described with a full set of features, it is to be understood that the disclosed system and apparatus may function successfully without the incorporation of each of those features. It is to be further understood that modifications and variations may be utilized without departure from the spirit and scope of this inventive apparatus, as those skilled in the art will readily understand. Such modifications and variations are considered to be within the purview and scope of the appended claims and their equivalents.

What is claimed is:

1. A concrete delivery truck, comprising: a) a chassis; b) a mixing drum rotatably associated with the chassis, the mixing drum having an interior cavity defining an interior surface and a central axis of rotation extending between a closed end and an open end; c) a helical flight extending along the interior surface of the mixing drum for delivering concrete to the open end of the drum, the helical flight having opposed side surfaces and opposed radially inner and radially outer ends, the radially outer end of the helical flight combining with the interior surface of the cavity so as to define opposed radially outer convergence zones adjacent the opposed side surfaces of the helical flight; and, d) means disposed within at least one of the opposed radially outer convergence zones for preventing the accumulation of concrete therein.

2. A concrete delivery truck as recited in claim 1, wherein the means disposed within at least one of the radially outer convergence zones for preventing the accumulation of concrete therein includes an expandable membrane extending across the at least one outer convergence zone from an adjacent side surface of the flight to the interior surface of the drum, and an expandable conduit disposed in the at least one outer convergence zone beneath the membrane, the membrane and conduit being configured to move between an unexpanded position and an expanded position to dislodge concrete accumulated thereon during rotation of the drum.

3. A concrete delivery truck as recited in claim 2, wherein the membrane is secured to the side surface of the flight and the interior surface of the drum by way of adhesives.

4. A concrete delivery truck as recited in claim 2, wherein the membrane is secured to the side surface of the flight and the interior surface of the drum by fasteners.

5. A concrete delivery truck as recited in claim 2, wherein the membrane is fabricated of an elastomer.

6. A concrete delivery truck as recited in claim 1, wherein means is disposed within each of the opposed radially outer convergence zones for preventing the accumulation of concrete therein.

7. A concrete delivery truck as recited in claim 1, wherein the means disposed within the radially outer convergence zones for preventing the accumulation of concrete therein includes an expandable conduit configured to move between an unexpanded position and an expanded position to dislodge concrete accumulated thereon during rotation of the drum.

8. A concrete delivery truck as recited in claim 1, further comprising: a) a fin positioned at a radially inner end of the helical flight, wherein the position of the fin relative to the side surfaces defines opposed radially inner convergence zones; and b) a fluid dispensing conduit disposed in each of the radially inner convergence zones.

9. A concrete delivery truck as recited in claim 8, wherein each fluid dispensing conduit includes openings configured to dispense fluid in the general direction of a respective opposed radially outer convergence zone.

10. A concrete delivery truck as recited in claim 1, wherein the interior surface of the mixing drum further includes a wear-resistance coating.

11. A concrete mixing drum having an interior cavity defining an interior surface and a central axis of rotation extending between a closed end and an open end, the mixing drum comprising: a) a helical flight extending along the interior surface of the mixing drum for delivering concrete to the open end of the drum, the helical flight having opposed side surfaces and opposed radially inner and radially outer ends, the radially outer end of the helical flight combining with the interior surface of the cavity so as to define opposed radially outer convergence zones adjacent the opposed side surfaces of the helical flight; and b) means disposed within at least one of the opposed radially outer convergence zones for preventing the accumulation of concrete therein.

12. A concrete mixing drum as recited in claim 11, wherein the means disposed within at least one of the opposed radially outer convergence zones for preventing the accumulation of concrete therein includes an expandable membrane extending across the at least one outer convergence zone from an adjacent side surface of the flight to the interior surface of the drum, and an expandable conduit disposed in the at least one outer convergence zone beneath the membrane, the membrane and conduit being configured to move between an unexpanded position and an expanded position to dislodge concrete accumulated thereon during rotation of the drum.

13. A concrete mixing drum as recited in claim 12, wherein the membrane is secured to the adjacent side surface of the flight and the interior surface of the drum by way of adhesives.

14. A concrete mixing drum as recited in claim 12, wherein the membrane is secured to the adjacent side surface of the flight and the interior surface of the drum by fasteners.

15. A concrete mixing drum as recited in claim 12, wherein the membrane is fabricated of an elastomer.

16. A concrete mixing drum as recited in claim 11, wherein means is disposed within each of the opposed radially outer convergence zones for preventing the accumulation of concrete therein.

17. A concrete mixing drum as recited in claim 11, wherein the means disposed within at least one opposed radially outer convergence zone for preventing the accumulation of concrete therein includes an expandable conduit configured to move between an unexpanded position and an expanded position to dislodge concrete accumulated thereon during rotation of the drum.

18. A concrete mixing drum as recited in claim 11, further comprising: a) a fin positioned at a radially inner end of the helical flight, wherein the position of the fin relative to the side surfaces defines opposed radially inner convergence zones; and b) a fluid dispensing conduit disposed in each of the radially inner convergence zones.

19. A concrete mixing drum as recited in claim 18, wherein each fluid dispensing conduit includes openings configured to dispense fluid in the general direction of a respective opposed radially outer convergence zone.

20. A concrete mixing drum as recited in claim 11, wherein the interior surface of the mixing drum further includes a wear-resistant coating.

21. A system for removing concrete from a helical flight extending along the interior surface of a concrete mixing drum, the helical flight having opposed side surfaces and opposed radially inner and radially outer ends, the radially outer end of the helical flight combining with the interior surface so as to define opposed radially outer convergence zones adjacent the opposed side surfaces of the helical flight, the system comprising means disposed within at least one of the opposed radially outer convergence zones for preventing the accumulation of concrete therein.

22. A system as recited in claim 21, wherein the means disposed within at least one of the opposed radially outer convergence zones for preventing the accumulation of concrete therein includes an expandable membrane extending across the at least one outer convergence zone from an adjacent side surface of the flight to the interior surface of the drum, and an expandable conduit disposed in the at least one outer convergence zone beneath the membrane, the membrane and expandable conduit being configured to move between an unexpanded position and an expanded position to dislodge concrete accumulated thereon.

23. A system as recited in claim 22, wherein the membrane is secured to an adjacent side surface of the flight and the interior surface of the drum by way of adhesives.

24. A system as recited in claim 22, wherein the membrane is secured to an adjacent side surface of the flight and the interior surface of the drum by fasteners.

25. A system as recited in claim 22, wherein the membrane is fabricated of an elastomer.

26. A system as recited in claim 21, wherein means is disposed within each of the opposed radially outer convergence zones for preventing the accumulation of concrete therein.

27. A system as recited in claim 21, wherein the means disposed within at least one of the opposed radially outer convergence zone for preventing the accumulation of concrete therein includes an expandable conduit configured to move between an unexpanded position and an expanded position to dislodge concrete accumulated thereon during rotation of the drum.

28. A system as recited in claim 21, further comprising: a) a fin positioned at a radially inner end of the helical flight, wherein the position of the fin relative to the side surfaces defines opposed radially inner convergence zones; and b) a fluid dispensing conduit disposed in one or more of the radially inner convergence zones.

29. A system as recited in claim 28, wherein the fluid dispensing conduits include openings configured to dispense fluid in the general direction of a respective opposed radially outer convergence zone.

30. A system as recited in claim 21, wherein the interior surface of the drum further includes a wear-resistant coating.

31. A system as recited in claim 21, wherein the helical flight further includes a wear-resistant coating.

* * * * *